US006161532A

United States Patent [19]

Goff et al.

[11] Patent Number: 6,161,532

[45] **Date of Patent: *Dec. 19, 2000**

[54] ARCHERY DRAWLOCK

[76] Inventors: Jerry Alan Goff; Sherwood Lunsford Goff, both of 21595 Yankee Town Rd., Saucier, Mich. 39574

[ * ] Notice: This patent is subject to a terminal disclaimer.

[21] Appl. No.: 09/478,237

[22] Filed: Jan. 4, 2000

Related U.S. Application Data

[63] Continuation of application No. 09/081,688, May 20, 1998, Pat. No. 6,032,661, which is a continuation-in-part of application No. 08/939,295, Sep. 29, 1997, Pat. No. 5,944,004, which is a continuation-in-part of application No. 08/778,659, Jan. 3, 1997, Pat. No. 5,671,723.

[51] Int. Cl.[7] ..... F41B 5/18; F41B 5/20; F41B 5/22

[52] U.S. Cl. ..... 124/35.2; 124/86; 124/88; 124/44.5

[58] Field of Search ..... 124/23.1, 24.1, 124/25.6, 35.2, 44.5, 86, 88, 89

[56] References Cited

U.S. PATENT DOCUMENTS

| | | | |
|---|---|---|---|
| 213,851 | 4/1879 | Streeter | 124/23.1 |
| 1,210,332 | 12/1916 | Kvistad | 124/23.1 |
| 1,526,176 | 2/1925 | O'Connell | 124/24.1 |
| 2,664,078 | 12/1953 | Irwin | 124/24.1 |
| 2,714,377 | 8/1955 | Mulkey | 124/23.1 |
| 2,757,657 | 8/1956 | Lohmeyer | 124/67 |
| 2,815,016 | 12/1957 | Kellogg | 124/35.2 |
| 2,816,537 | 12/1957 | Irwin | 124/24.1 |
| 2,926,650 | 3/1960 | Irwin | 124/24.1 |
| 2,982,279 | 5/1961 | Pursley | 124/35.1 |
| 3,015,328 | 1/1962 | Ryder | 124/87 |
| 3,446,200 | 5/1969 | Gross | 124/24.1 |
| 3,512,512 | 5/1970 | Wentz | 124/24.1 |
| 3,561,418 | 2/1971 | Fredrickson | 124/24.1 |
| 3,895,621 | 7/1975 | Kellogg | 124/24.1 |
| 4,027,645 | 6/1977 | Damron | 124/24.1 |
| 4,041,925 | 8/1977 | Barrick | 124/35.2 |
| 4,385,618 | 5/1983 | Nishioka | 124/24.1 |
| 4,466,418 | 8/1984 | Jones | 124/35.2 |
| 4,603,676 | 8/1986 | Luoma | 124/25 |
| 4,829,974 | 5/1989 | Anderson | 124/24.1 |
| 4,919,107 | 4/1990 | Bunts | 124/24.1 |
| 5,002,035 | 3/1991 | Brooks | 124/23.1 |
| 5,065,730 | 11/1991 | Kluver | 124/35.2 |
| 5,092,308 | 3/1992 | Sheffield | 124/25 |
| 5,140,972 | 8/1992 | Fisk | 124/44.5 |
| 5,156,138 | 10/1992 | Grover | 124/35.2 |
| 5,161,514 | 11/1992 | Cary | 124/24.1 |
| 5,205,267 | 4/1993 | Burdick | 124/24.1 |
| 5,390,654 | 2/1995 | Perkins | 124/24.1 |
| 5,465,705 | 11/1995 | Baeseman | 124/88 |
| 5,490,492 | 2/1996 | Savage | 124/44.5 |
| 5,671,723 | 9/1997 | Goff et al. | 124/35.2 |
| 5,944,004 | 8/1999 | Goff et al. | 124/35.2 |

FOREIGN PATENT DOCUMENTS

| | | | |
|---|---|---|---|
| 524405 | 5/1956 | Canada . | |
| 2 053 009 | 2/1981 | United Kingdom | 124/35.2 |

OTHER PUBLICATIONS

Advertisement, Bow–Pro Archery Equipment entitled "Release System".

*Primary Examiner*—John A. Ricci
*Attorney, Agent, or Firm*—Seidel, Gonda, Lavorgna & Monaco, PC

[57] ABSTRACT

The invention comprises an archery bow with a drawlock device adapted for use with an overdraw arrow rest. The device includes an elongated mounting bracket attached at its forward end to the bow's handle, and having intermediate its forward and rearward ends an overdraw arrow rest. The device further includes a draw tube attached to the rearward end of the mounting bracket and a draw rod in telescoping engagement with the draw tube. In a preferred embodiment, the draw tube can be attached to the mounting bracket at a selectable angle to align with the axis of the arrow between nock point and arrow rest after vertical adjustment to a tuned knocking point. The back end of the draw rod supports a bow string mechanical release. A latching device locks and holds the draw rod at a full draw position when the bow string is drawn beyond the full draw position.

9 Claims, 3 Drawing Sheets

ARCHERY DRAWLOCK

CROSS REFERENCE TO RELATED APPLICATIONS

This application is a continuation of application Ser. No. 09/081,688 filed May 20, 1998, now U.S. Pat. No. 6,032,661; which is a continuation-in-part of application Ser. No. 08/939,295, filed Sep. 29, 1997 and issued as U.S. Pat. No. 5,944,004; which is a continuation-in-part of application Ser. No. 08/778,659, filed Jan. 3, 1997 and issued as U.S. Pat. No. 5,671,723.

FIELD OF THE INVENTION

The present invention relates to the general field of archery bow accessories, and to the more specific field of devices which lock the bow string at full draw until the archer is ready to release the arrow.

BACKGROUND OF THE INVENTION

Drawlocks of various types have been used by archers for many years, including the locking mechanisms on centuries-old crossbows. For upright bows a drawlock has generally been either a fixed rod along which the bow string is drawn or a moveable rod drawn along with the bow string. Both types use some sort of latch mechanism to lock the string at full draw, and a release mechanism to release the string and propel the arrow. A representative example of the fixed rod type is disclosed in U.S. Pat. No. 2,926,650; a representative example of the moveable rod type is disclosed in U.S. Pat. No. 2,982,279.

The modern upright bow design has evolved from long bow through recurve and compound bows of numerous varieties, and the range of arrow rests, bow sights, stabilizers, mechanical releases, and other accessories has likewise proliferated. While some earlier forms of drawlock may be usable with modern bows and accessories, it is an objective of this invention to provide a modern drawlock for the contemporary design of a compound bow, particularly a bow equipped with an overdraw arrow rest. An overdraw rest permits the use of shorter, lighter arrows to increase velocity and flatten arrow trajectory. It is an objective of this invention to provide for an overdraw rest and shelf to be mounted on the drawlock device at a selectable overdraw distance.

The type of compound bow for which this drawlock is designed has a handle portion with a sight window above the grip that is cut past the center of the handle to allow fletching clearance and allow sideways arrow rest adjustment. This sight window and the hand configuration of the grip make the bow either "right handed" or "left handed". The present invention to make a universal drawlock which can be mounted on either a right or left handed compound bow.

Modern compound bows of this type usually have a threaded hole drilled and tapped through the handle directly above the grip to receive an arrow rest. The bow manufacturer usually locates the hole precisely at the "pivot-point" area of the handle, which moves less than any other part of the handle as the bow torques and vibrates during a shot. It is an objective of this invention to use this pre-drilled arrow rest hole to attach the drawlock to the handle.

With the arrow rest hole used to support the drawlock device, the overdraw rest must be supported elsewhere. It is an objective of this invention to allow the mounting of an overdraw arrow rest and an overdraw shelf on the drawlock at a selectable rearward position from approximately one to five inches behind the grip.

With the overdraw arrow rest located well behind the "pivot point", the bad effect on accuracy of minor release or tuning errors is increased. For this reason, most archers using an overdraw will find that they shoot better with a mechanical string release than with a finger release. For the same reason, in tuning the bow the nocking point on the string must be carefully adjusted to eliminate up-and-down wobble of the arrow in flight, and the arrow rest carefully adjusted horizontally to eliminate side-to-side wobble. It is an objective of this invention to have a drawlock which is alignable with the tuned locations of nock point and arrow rest.

It is another objective of the invention to provide a superior and more positive latching of the drawlock rod at full draw.

Further advantages of the invention may be appreciated by reading the following descriptions.

SUMMARY OF THE INVENTION

The invention comprises an archery drawlock device adapted for use with an overdraw arrow rest. The device includes an elongated mounting bracket having near its forward end a bolt slot for attaching the bracket to an archery bow's handle, and having intermediate its forward and rearward ends an elongated slot for mounting an overdraw arrow rest at a selectable distance to the rear of the bow's handle. The device further includes a draw tube attached to the rearward end of the mounting bracket and a draw rod in telescoping engagement with the draw tube. In a preferred embodiment, the draw tube can be attached to the bow at a selectable angle to align with the axis of the arrow between nock point and arrow rest after vertical adjustment to a tuned knocking point. The back end of the draw rod supports a bow string mechanical release. A latching device locks and holds the draw rod at a full draw position when the bow string is drawn beyond the full draw position.

BRIEF DESCRIPTION OF THE DRAWINGS

The drawings show a form of the invention which is presently preferred; however, the invention is not limited to the precise arrangement shown in the drawings.

DETAILED DESCRIPTION OF THE INVENTION

Figure 1:
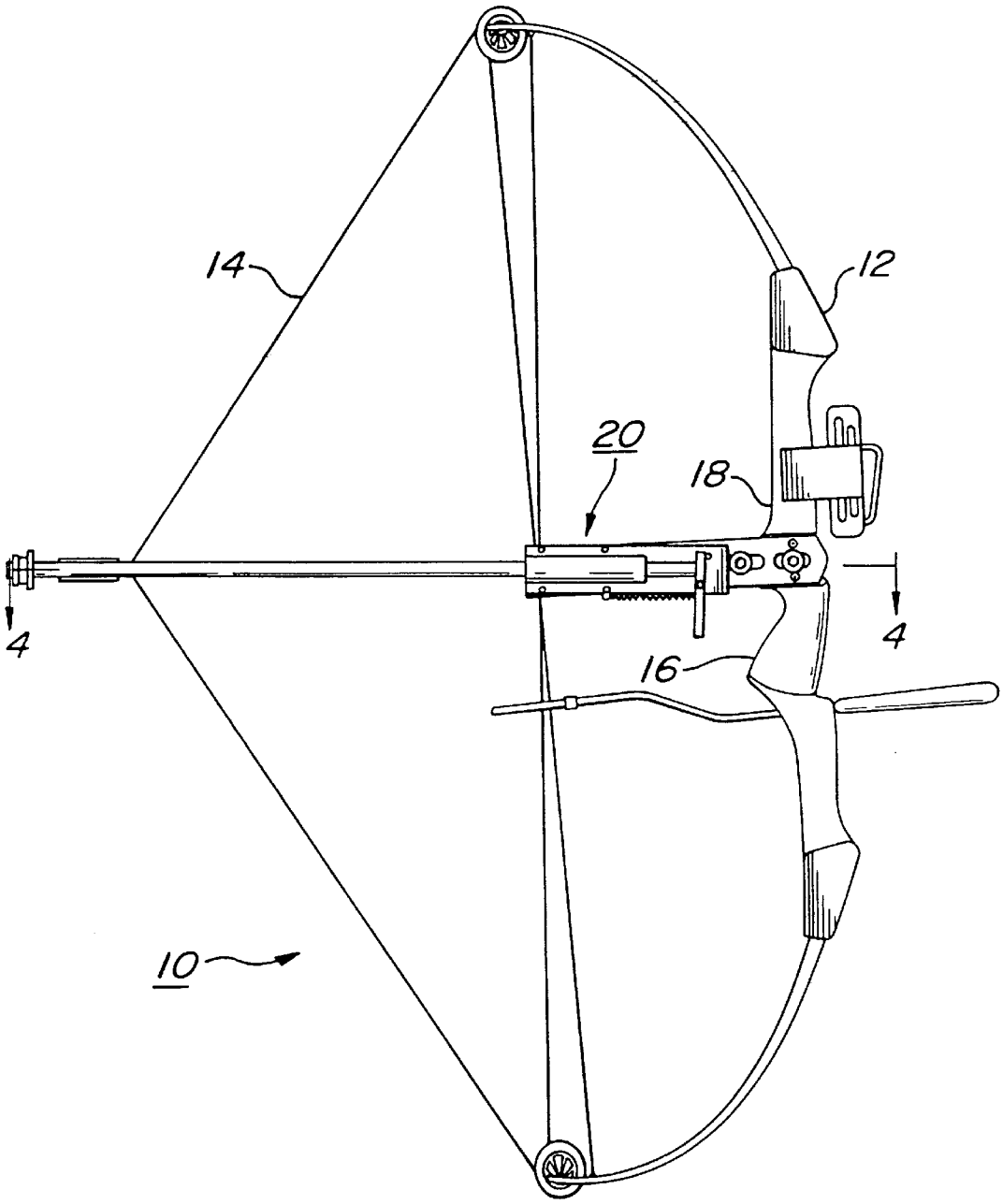
FIG. 1 is a side view of a compound bow on which a drawlock according to the invention is attached for a right-handed archer, and is shown in the drawn and locked position.

FIG. 1 shows a generic compound bow (10) having a handle (12), upper and lower limbs each having an eccentric wheel, a bowstring (14), a cable guard, a stabilizer, and a bow sight (the unnumbered elements are easily identified and not significant to a description of the invention). The handle is designed for a "right-handed" archer; that is, an archer who grips the handle with his left hand and draws the bow with his right hand. Consequently, the handle has a grip (16) conforming ergonomically to a left hand grasp. Directly above the grip on the palm side is a sight window (18). The sight window is a "center-shot" configuration, in that the sight window is cut past the vertical centerline of the handle to allow clearance for the arrow fletching and sideways arrow rest adjustment. In this bow's normal configuration, an arrow rest would be attached in the sight window. However, in the configuration depicted and described herein, the bow will be equipped with an "overdraw" arrow rest.

Figure 2:
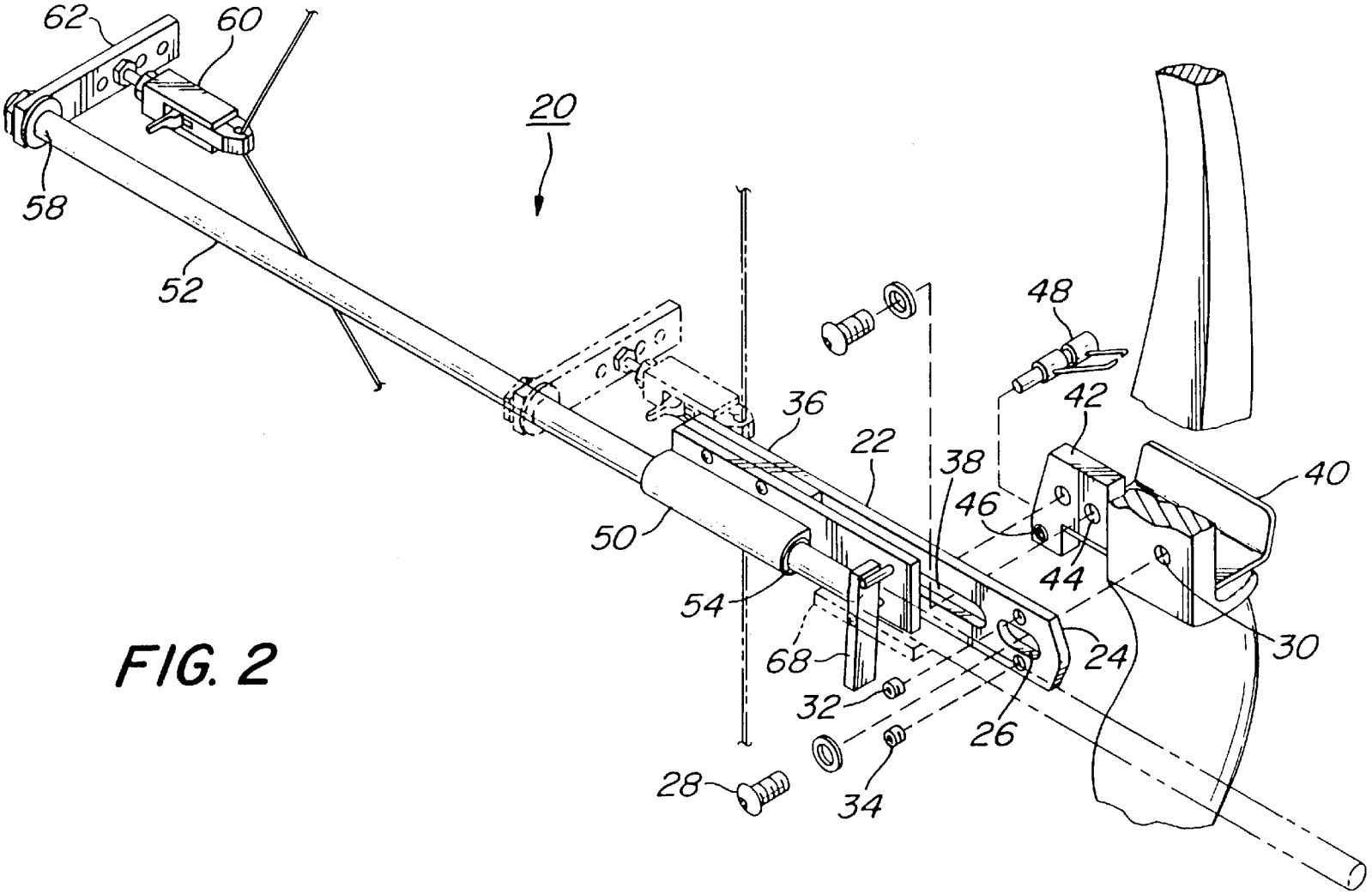
FIG. 2 is a perspective view of the drawlock of FIG. 1, exploded from the bow, and shown by ghost lines in an undrawn position.
Figure 4:
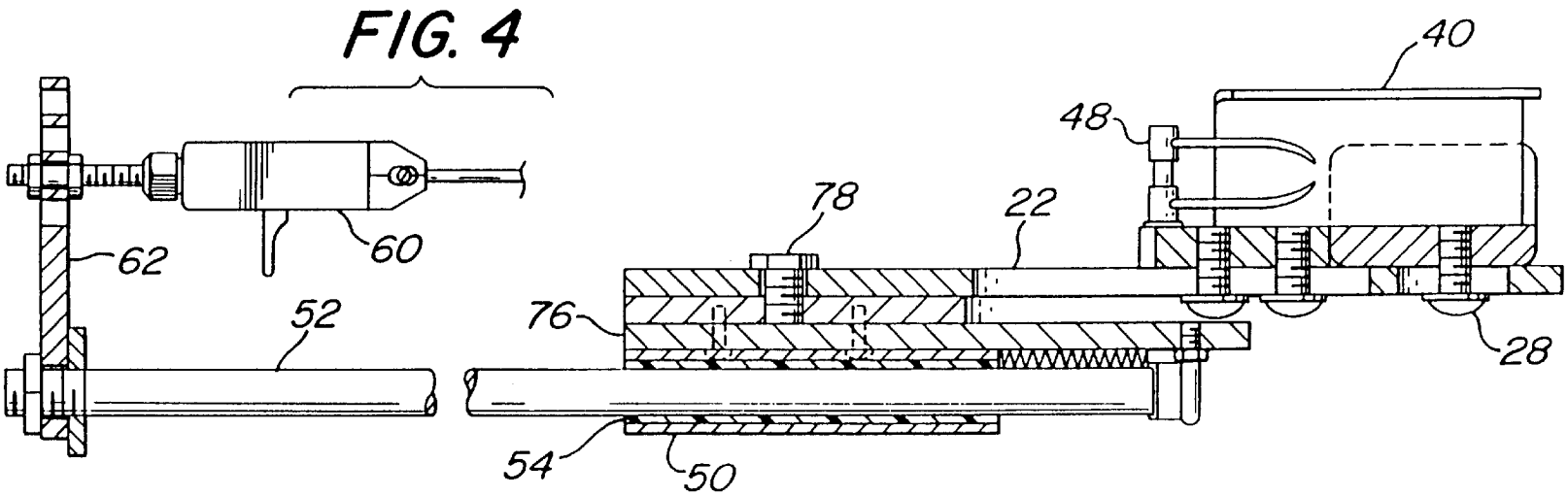
FIG. 4 is a top view of portions of the drawlock of FIG. 1.

The invention is an archery drawlock device (20) which is adapted for use with an overdraw arrow rest. As shown in FIGS. 2 and 4, the drawlock device (20) includes an elongated mounting bracket (22). At the forward end (24) of the bracket (22) is the means by which the bracket is attached to the handle of the bow. An aperture (26) through the forward end of the bracket allows the shaft of a threaded bolt (28) to be screwed into a pre-drilled and taped arrow rest hole (30) in the handle, with the head of the bolt (28) tightened down against the mounting bracket (a washer may be inserted between bolt head and bracket). Set screws (32, 34) are located above and below the aperture (26) and are tightened against the handle to lock the bracket in a position generally perpendicular to the handle. In the preferred embodiment depicted, the aperture (26) is a short slot aligned with the long axis of the bracket (22), as depicted in the drawings. The slot-aperture (26) allows the bracket to be adjusted slightly fore or aft of the pre-drilled arrow rest hole (30) before tightening the bolt 28, so that the set screws can be positioned against a flat surface of the handle. Otherwise, the aperture (26) could be merely a round hole of proper diameter.

Behind the aperture (26), and intermediate the forward end (24) and the rearward end (36) of the mounting bracket is the means by which an overdraw arrow rest can be supported at a selectable position to the rear of the bow's handle. An elongated slot (38), having a longitudinal axis generally aligned along the long axis of the mounting bracket (22), is adapted to receive a bolt coupling an overdraw shelf and arrow rest to the bracket. In the embodiment depicted, the overdraw shelf (40) is attached to a mounting plate (42) which has one or two bolt holes (44) and a threaded port (46) for the attachment of a variety of arrow rests. The arrow rest (48) depicted is a launcher-style rest with a two-prong arrow support, but other types of rest can be used. The concept of the overdraw rest is that the arrow is supported behind the grip, enabling full draw with a shorter, lighter arrow. The length of the elongated slot (38) permits this overdraw distance to adjusted between approximately one to five inches behind the grip. The overdraw arrow rest and shorter arrow shaft place the hunting broadhead behind the bow hand and wrist at full draw. The overdraw shelf provides a guard for the hand and wrist if the arrow jumps the rest at or before string release.

The drawlock device (20) further includes a draw tube (50) attached to the mounting bracket (22) near the rearward end (36) of the bracket. The tube (50) is intended to allow telescoping movement of a draw rod (52). The draw tube is preferably a metal exterior tube lined with a soft bushing (54) of material such as PVC or other plastic composition to eliminate the noise that would be produced by metal-to-metal contact with the draw rod. The draw rod (52) has a blunt end (56) for insertion through the draw tube and a second, opposite end (58) which supports a bow string mechanical release (60). The preferred type release is the style known as a "caliper" release with a free-swiveling head and a trigger. Since the draw lock system permits the bow to be carried in a full draw position, a preferred release also has a trigger safety (not depicted) of some type, such as a safety similar to the cross-bar safety in the trigger guard of many rifles and shotguns.

A spacer bar (62) is used to space the release a proper distance from the draw bar. One end of the spacer bar is attached to the back end (58) of the draw rod. The spacer bar has several attachment holes to attach the release at a selectable distance from the draw bar, depending upon the thickness of the grip and location of the eccentric cable tracks (the string on a compound bow should be aligned with the cable track of the eccentric wheels). The spacer bar (62) further serves as a finger grip to draw the string.

The drawlock device (20) further includes a latching means for locking and holding the draw rod at a full-draw position. The latching means includes a pivot pin (64) located on the mounting bracket (22) on one side of the elongated slot (38), and a stop pin (66) located on the opposite side of the slot (38), generally directly across the slot from the pivot pin. A latch bar (68) is rotatably mounted on the pivot pin (64) at a position intermediate the ends of the bar (68). The length of the bar from a first end (70) to the pivot pin (64) is greater than the distance between the pivot pin (64) and the stop pin (66). A spring (72) is attached to the latch bar between the pivot pin and the opposite, second end (74) of the bar, and the other end of the spring is attached to the mounting bracket to the rear of the pivot pin (66). The spring is biased to pivot the first end of the bar toward the stop pin. When the draw rod is in the undrawn position shown by ghost lines in FIGS. 2 and 3, the latch bar lies along the rod with the spring tensioned. When the string is drawn past full-draw position, the draw rod moves past the first end of the latch bar, and the spring causes the bar to pivot across the slot (38) until the bar strikes the stop pin (66). The draw can then be relaxed slightly to bring the blunt end of the rod into contact against the bar. The pressure of the drawn string will the hold the rod firmly against the bar, effectively locking the bow in a full-draw position. (The term "full-draw" is used herein to mean the aimed draw position for a bow properly matched to the archer, rather than an absolute maximum draw.) This latching means achieves the objective of providing a superior and more positive latching of the drawlock rod at full draw than found in prior drawlocks.

Figure 3:
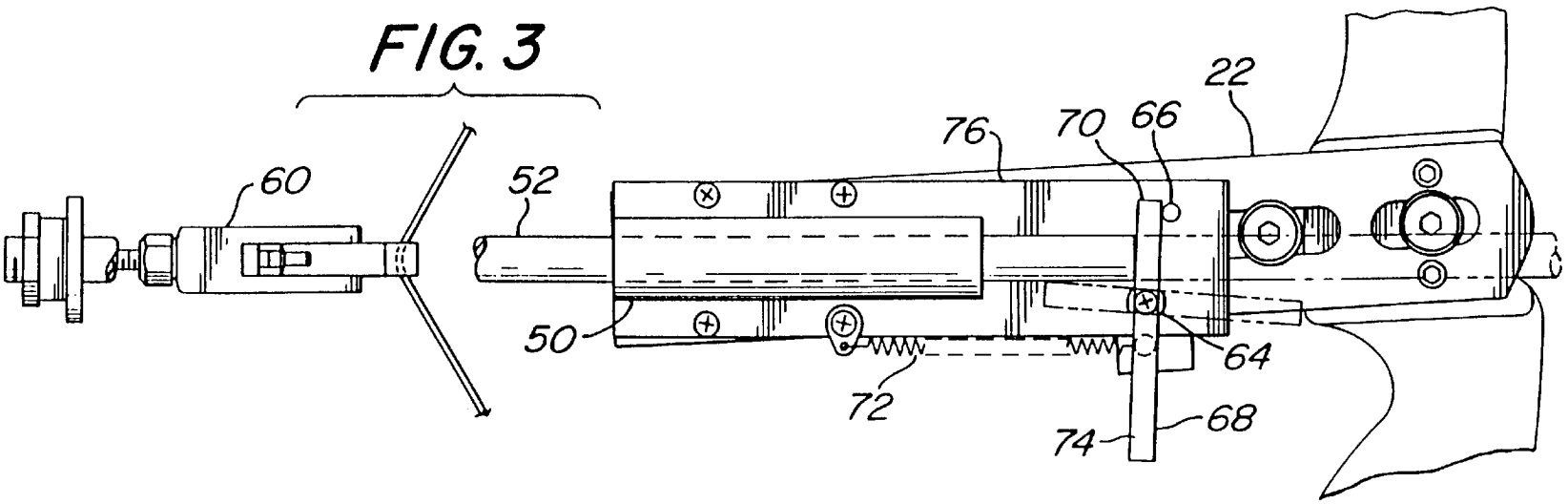
FIG. 3 is a side view of portions of the drawlock of FIG. 1, showing the mechanical string release and the draw rod latching mechanism in greater detail.

As shown in FIG. 3, a preferred embodiment is that in which the draw tube (50), pivot pin (64), stop pin (66) and spring (72) are mounted on a mounting plate (76) which can be attached to the mounting bracket (22) at a selectable angle, such as by a bolt (78). This allows the axis of the tube to be aligned with the axis of the arrow from nock point to rest, which may be at an angle slightly above or below the axis of the mounting bracket, depending upon the tuning needed to eliminate vertical wobble of the arrow in flight. By aligning the draw tube with the arrow, the draw rod is centered in the tube during the draw, eliminating any additional draw weight which would be caused by friction between tube and rod in an off-center alignment. However, even with this selectable angle plate, the stop pin is still on the opposite side of the slot from the pivot pin and still generally directly across the slot from the pivot pin.

Although the drawlock device is described herein as it is mounted on a right-handed bow, it can easily be seen that the device is just as adeptly mounted on a left-hand bow. The mounting bracket merely inverts top to bottom when it is mounted on a left-hand bow, with the only asymmetry being that the pivot pin and spring are now above the slot (38) instead of below it. However, the spring will still pull the latch bar across the slot and into the stop pin in exactly the same manner when the draw rod is retracted beyond full draw.

The overdraw device can be used in several modes. The arrow can be nocked with the bow undrawn, then the bow can be drawn when the game animal approaches and briefly locked in the drawn position until the quarry presents a clear target at a vulnerable aspect. Alternatively, the bow can be drawn and locked at the carry with no arrow loaded until the hunter reaches a stand or game is sighted.

This invention may be embodied in other specific forms without departing from its spirit or essential attributes. Accordingly, reference should be made to the following claims, rather than to the foregoing description, to determine the fuller scope of the invention.

We claim:

1. An archery bow comprising a handle, limbs, a drawstring, an overdraw arrow rest and a drawlock device, the drawlock device comprising:

an elongated mounting bracket having a forward end and a rearward end, the forward end of the mounting bracket being connected to the bow handle and the overdraw arrow rest being attached to the mounting bracket to the rear of the bow handle;

a draw tube attached to the mounting bracket adjacent the rearward end of the mounting bracket;

a draw rod having a first end for insertion through the draw tube and a second end supporting a bow string mechanical release; and a latching device for locking and holding the draw rod at a full draw position when the bow string is drawn beyond the full draw position.

2. The bow of claim 1, wherein the mounting bracket has a slot intermediate the forward and rearward ends and generally aligned along the longitudinal axis of the mounting bracket between the forward and rearward ends, the slot adapted to receive a bolt for coupling the overdraw rest to the bracket.

3. The bow of claim 2, further comprising means for attaching the draw tube to the mounting bracket at a selectable angle to permit the tube to be aligned with a drawn arrow.

4. The bow of claim 2, further comprising a spacer bar attached at one end thereof to the second end of the draw rod, the spacer bar adapted to receive the release at various separation distances from the draw rod.

5. The bow of claim 1, wherein the latching device comprises:

a pivot pin located on the bracket on one side of the slot, a stop pin located on the bracket on the side of the slot opposite the pivot pin and generally directly across the bracket from the pivot pin along a line transverse to the bracket, a bar rotatably mounted on the pivot pin at a position intermediate the ends of the bar, the bar having a length such that the distance from a first end of the bar to the pivot pin is greater than the distance between the pivot pin and the stop pin, and a spring means attached to the bar between the second end of the bar and the pivot pin and biased to pivot the first end of the bar toward the stop pin.

6. The bow of claim 5, further comprising means for attaching the draw tube to the mounting bracket at a selectable angle to permit the tube to be aligned with a drawn arrow.

7. The bow of claim 5, further comprising a spacer bar attached at one end thereof to the second end of the draw rod, the spacer bar adapted to receive the release at various separation distances from the draw rod.

8. The bow of claim 1, further comprising means for attaching the draw tube to the mounting bracket at a selectable angle to permit the tube to be aligned with a drawn arrow.

9. An archery bow comprising a handle, limbs, a drawstring, an overdraw arrow rest and a drawlock device, the drawlock device comprising:

an elongated mounting bracket extending rearwardly from the handle;

a draw tube attached to the mounting bracket at a position to the rear of the handle;

a draw rod having a first end for insertion through the draw tube and a second end supporting a bow string mechanical release; and a latching device for locking and holding the draw rod at a full draw position when the bow string is drawn beyond the full draw position, the latching device comprising a pivot pin located on the bracket in front of the draw tube, a stop pin located on the bracket in front of the draw tube and generally directly across the bracket from the pivot pin along a line transverse to the bracket, a bar rotatably mounted on the pivot pin at a position intermediate the ends of the bar, the bar having a length such that the distance from a first end of the bar to the pivot pin is greater than the distance between the pivot pin and the stop pin, and a spring means attached to the bar between the second end of the bar and the pivot pin and biased to pivot the first end of the bar toward the stop pin.

* * * * *